US010684000B2

(12) United States Patent
Rau

(10) Patent No.: US 10,684,000 B2
(45) Date of Patent: Jun. 16, 2020

(54) INLINE MAST ADAPTER APPARATUS FOR A LIGHT TOWER

(71) Applicant: DIVERSIFIED PRODUCTS, LLC, Omaha, NE (US)

(72) Inventor: Michael A. Rau, Omaha, NE (US)

(73) Assignee: DIVERSIFIED PRODUCTS, LLC, Omaha, NE (US)

( * ) Notice: Subject to any disclaimer, the term of this patent is extended or adjusted under 35 U.S.C. 154(b) by 0 days.

(21) Appl. No.: 15/893,124

(22) Filed: Feb. 9, 2018

(65) Prior Publication Data

US 2018/0231223 A1 Aug. 16, 2018

Related U.S. Application Data

(60) Provisional application No. 62/457,358, filed on Feb. 10, 2017.

(51) Int. Cl.

| | |
|---|---|
| ***F21V 21/26*** | (2006.01) |
| ***B66F 3/38*** | (2006.01) |
| ***B66F 3/24*** | (2006.01) |
| *F21W 131/10* | (2006.01) |

(52) U.S. Cl.

CPC ..... *F21V 21/26* (2013.01); *B66F 3/247* (2013.01); *B66F 3/38* (2013.01); *F21W 2131/1005* (2013.01)

(58) Field of Classification Search

None

See application file for complete search history.

(56) References Cited

U.S. PATENT DOCUMENTS

| | | | | |
|---|---|---|---|---|
| 4,600,980 A * | 7/1986 | Dahlgren | E04H 12/182 362/385 |
| 6,065,621 A * | 5/2000 | Fatemi | B66C 23/48 212/264 |
| 6,082,552 A * | 7/2000 | Pollock | B62H 3/12 211/104 |
| 6,854,862 B1 * | 2/2005 | Hopf | F21L 14/04 362/220 |
| 2017/0022037 A1 * | 1/2017 | Mast | B66F 3/247 |

OTHER PUBLICATIONS

Multiquip GloBug brochure, 2017.

Multiquip Nighthawk Series, Operation Manual, Revision #12, Jan. 20, 2009.

Generac Magnum, MLT6S/MLT8S Series, Mobile Light Towers brochure, Oct. 2015.

* cited by examiner

*Primary Examiner* — Sharon E Payne

(74) *Attorney, Agent, or Firm* — Ballard Spahr LLP

(57) ABSTRACT

An inline mast adapter configured for attaching a light fixture, where a light fixture is aligned (within 15.24 cm, as measured horizontally, from the center of the light fixture) with an extendable tower mast, when the extendable tower mast is in a vertical position. The inline mast adapter includes a pivot arm, such that a light fixture may be attached from ground level. The inline mast adapter further includes a first gas spring and a second gas spring configured for rotational movement for rotationally moving the pivot arm to a vertical position. Further, the inline mast adapter may be an after-market add on to the extendable tower mast, such that the inline mast adapter is a kit.

19 Claims, 7 Drawing Sheets

INLINE MAST ADAPTER APPARATUS FOR A LIGHT TOWER

REFERENCE TO RELATED APPLICATIONS

This application claims the benefit of U.S. Provisional Application No. 62/457,358 entitled "INLINE MAST ADAPTER APPARATUS FOR A LIGHT TOWER" filed Feb. 10, 2017, which is incorporated by reference in its entirety.

BACKGROUND

Lighting on outdoor job sites, such as construction or railroad projects, promotes efficient completion of a project. In order to work on a job site when sufficient daylight is not present, indirect lighting (e.g. the light source is not sourced from or attached to the construction equipment) provides a solution. An indirect light source must provide a sufficient quality (e.g. brightness and intensity) of light in order to conduct work at a job site.

The quality of the light from the indirect light source at the project area depends partially on the height of the indirect light source as compared to the project area. The height of the light source influences the area that the light source covers and the intensity of the light at the project area. An indirect light source that has a low height (e.g. close to the ground) yields light that reaches a small area and is less likely to reach the project area with sufficient quality. An indirect light source that has a high height (e.g. far from the ground) yields light that reaches a large area, but may not reach the project area with sufficient quality.

Conventional methods of indirect lighting include raising a light source (e.g. a light-emitting diode (LED) balloon light, LED light, or metal halide light) on an extendable tower mast. These conventional indirect lighting apparatuses present practical limitations for indirect lighting. For example, conventional methods include the use of a ladder or other height raising mechanism for installation of the light source on the extendable tower mast. The need for additional equipment to produce a functioning indirect light source is inefficient, as it requires additional action by a user and additional equipment. Further, requiring an individual to use a ladder to attach a light source to the extendable tower mast is more dangerous than attachment of the light source from ground level (e.g. a user may stand on the ground and attach the light source), which increases risk of injury.

Further, conventional methods that allow for installation of the light source without the use of a ladder or other height raising mechanism, do not allow alignment of light source (e.g. be within 15.24 centimeters (cm) (6 inches)) with the extendable tower mast. Without alignment of the light source and extendable tower mast, the center of gravity of the light source is different from the center of gravity from the base of the extendable tower mast as compared on a vertical axis, creating a less stable unit than if the center of gravity of the light source and base are aligned. This instability means that the extendable tower mast cannot raise to its full height, as there are concerns of tipping at the base. Further, the difference in the center of gravity, as compared on a vertical axis, creates additional stress on the extendable tower mast, putting more stress on the parts than if the center of gravity of the light source and extendable tower mast are aligned. This additional stress causes parts to fail at a faster rate than if the centers of gravity of the tower mast and base are aligned.

It is desirable to have an apparatus for adapting an extendable tower mast to allow for a light source to be installed at ground level, while still allowing for alignment of the light source and extendable tower mast. It is further desirable to have an apparatus for adapting an extendable tower that allows the extendable tower to be raised to its full height.

SUMMARY

Inline mast adapters are described. In one aspect of the invention an inline mast adapter apparatus for adapting an extendable tower mast, the inline mast adapter includes an attachment system, the attachment system comprising, an attachment backing plate, attachment hardware, an attachment frame, and an attachment arm, wherein the attachment backing plate, the attachment hardware, the attachment frame, and the attachment arm are in mechanical communication, a support bracket, wherein the support bracket is in mechanical communication with the attachment arm of the attachment system, a first gas spring, the first gas spring comprising, a first gas spring rod and a release handle, wherein the first gas spring rod is in gaseous communication with the first gas spring, and wherein the release handle is in mechanical communication with the first gas spring rod, and wherein the first gas spring is in mechanical communication with the support bracket, a second gas spring, the second gas spring comprising, a second gas spring rod, wherein the second gas spring rod is in gaseous communication with the second gas spring, and wherein the second gas spring rod is in mechanical communication with the release handle, and wherein the second gas spring is in mechanical communication with the support bracket, a first gas spring mount, wherein the first gas spring mount is in mechanical communication with the first gas spring, a second gas spring mount, wherein the second gas spring mount is in mechanical communication with the second gas spring, a pivot arm, the pivot arm comprising a light mount shaft, wherein the light mount shaft is in mechanical communication with the pivot arm, and wherein the pivot arm is in mechanical communication with the first gas spring mount, the second gas spring mount, and the attachment arm of the support system.

In another aspect of the invention a method for attaching a light fixture to an inline mast adapter at ground level to provide indirect light to a work site, the method comprising placing a light fixture on a light mount shaft of a pivot arm of an inline mast adapter, engaging a lift assist lever of a first gas spring to allow the first gas spring and a second gas spring to move, wherein the lift assist lever is in mechanical communication with the first gas spring and the second gas spring, lifting the pivot arm in a substantially rotational movement to a vertical position, wherein the light mount shaft is from 0.0254 centimeters to 12.7 centimeters from an attachment backing plate in the vertical position, locking the pivot arm in the vertical position, disengaging the lift assist lever of the first gas spring to lock the first gas spring and the second gas spring, providing indirect light to the work site.

In another aspect of the invention an inline mast adapter kit comprising an inline mast adapter comprising, an attachment backing plate, attachment hardware, an attachment frame, an attachment arm, a support bracket, a first spring mount, a second spring mount, at least two spring mount pins, a first gas spring, a second gas spring, a lift assist release lever, a first gas spring mount pin, a second gas spring mount pin, a rod mount pin, a pivot arm, a light mount shaft, a handle, a pivot arm pin, a vertical locking cradle, and a vertical pin.

FIGURES

DETAILED DESCRIPTION

An inline mast adapter configured for attaching a light fixture, where a light fixture is aligned (within 15.24 cm, as measured horizontally, from the center of the light fixture) with an extendable tower mast, when the extendable tower mast is in a vertical position. The inline mast adapter includes a pivot arm, such that a light fixture may be attached from ground level. The inline mast adapter further includes a first gas spring and a second gas spring configured for rotational movement for rotationally moving the pivot arm to the vertical position. While it is to be understood that the inline mast adapter could be shown for use on a number of different masts, for illustration purposes, it is disclosed and described as being associated with attachment to an extendable tower mast.

Figure 1:
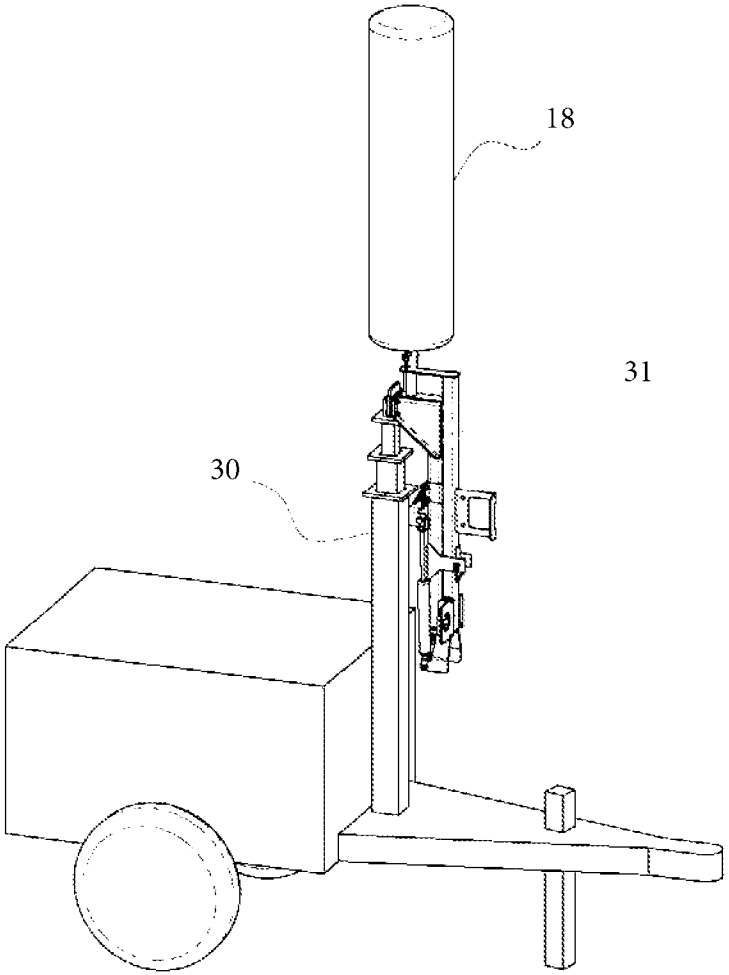
FIG. 1 is a side angled view of a light tower trailer and an extendable tower mast having an inline mast adapter.

FIG. 1 represents a side angled view of a light tower trailer 29 and an extendable tower mast 30 having an inline mast adapter 31. The light tower trailer 29 includes an extendable tower mast 30, an inline mast adapter 31, and a light fixture 18. The inline mast adapter 31 is in bolted communication with the extendable tower mast 30. The light fixture 18 is in sliding mechanical communication with the inline mast adapter 31.

Figure 2:
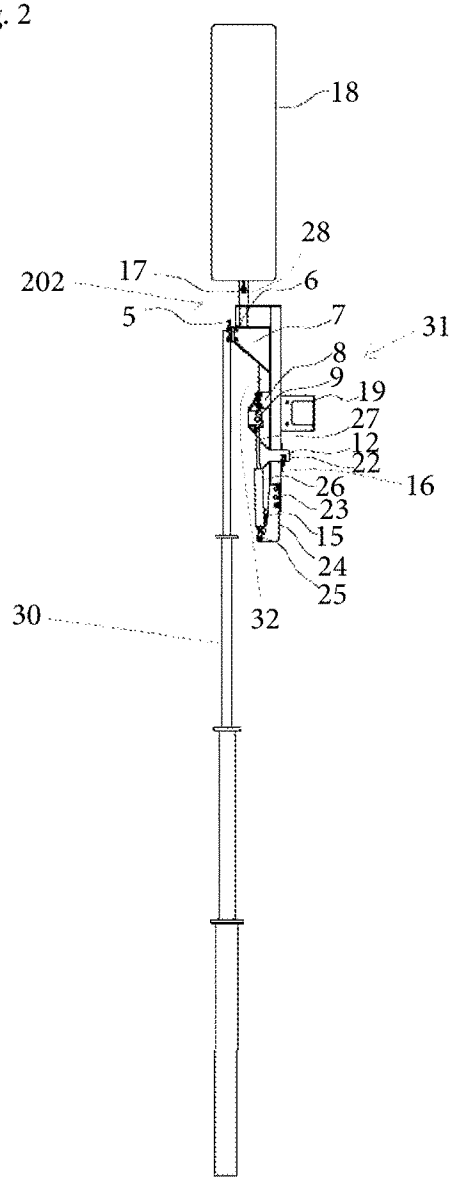
FIG. 2 is a side view of an inline mast adapter in a vertical position.

FIG. 2 represents an extendable tower mast having an inline mast adapter in a vertical position. The inline mast adapter 31 includes an attachment system 202. The attachment system 202 may include an attachment backing plate 5, attachment hardware 6, an attachment frame 7, and an attachment arm 32. The inline mast adapter 31 further includes a support bracket 8, a rod mount pin 9, at least two spring mount pins 23, a first gas spring mount pin 25, a second gas spring mount pin (not pictured, see 14 in FIG. 4), a light mount shaft 28, a vertical locking cradle 22, a vertical locking pin 12, a first gas spring 26 having a first gas spring rod 27, a second gas spring (not pictured) having a second gas spring rod (not pictured), a first gas spring mount 24, a second gas spring mount (not pictured), a pivot arm 16, a pivot arm pin 15, and a release handle (not pictured). The inline mast adapter may include a light fixture 18, a light fixture pin 17, and a handle 19.

The attachment system 202 is configured for attaching the inline mast adapter 31 to an extendable tower mast 30. The attachment backing plate 5 is in mechanical communication with the extendable tower mast 30. The attachment hardware 6, is in bolted communication with the attachment backing plate 5 and the extendable tower mast 30. The attachment hardware 6 and the attachment backing plate 5 may be formed as a single piece, such as through a cast mold, or the like.

The attachment frame 7 is in bolted communication with the attachment hardware 6 and the attachment backing plate 5. The attachment frame 7 is in mechanical communication with the attachment arm 32. The attachment frame 7 and the attachment arm 32 may be formed as a single piece, such as through a cast mold, or the like. The attachment backing plate 5, the attachment hardware 6, the attachment frame 7, and the attachment arm 32 may be made of any material capable of bearing the load from the pivot arm and the light, such as metal, metal composites, or synthetic polymers.

The support bracket 8 is configured for supporting the first gas spring 26 and the second gas spring. The support bracket 8 is in bolted communication with the attachment system 202. The support bracket 8 may be in bolted communication with the attachment arm 32 of the attachment system 202. The support bracket 8 may be made of any material capable of bearing the first gas spring 26 and the second gas spring, such as metal, metal composites, or synthetic polymers.

The rod mount pin 9 is configured for securing the support bracket 8, the first gas spring 26, and the second gas spring in mechanical communication. The rod mount pin 9 may be a bolt, screw, or rivet. The rod mount pin 9 may be any material capable of securing the support bracket 8, the first gas spring 26 and the second gas spring in mechanical communication, such as metal, metal composite, or synthetic polymer.

The two or more spring mount pins 23 are configured for securing the first spring mount 24 and the pivot arm 16 in mechanical communication, and for securing the second spring mount and the pivot arm 16 in mechanical communication. The one or more spring mount pins 23 may be a bolt, screw, or rivet. The one or more spring mount pins 23 may be any material capable of securing the first spring mount 24 and the pivot arm 16 in mechanical communication, and capable of securing the second spring mount and the pivot arm 16 in mechanical communication, such as metal, metal composite, or synthetic polymer.

The first gas spring mount pin 25 is configured for securing the first gas spring 26 to the first spring mount 24 in mechanical communication. The first gas spring mount pin 25 may be a bolt, screw, or rivet. The first gas spring mount pin 25 may be any material capable of securing the first gas spring 26 to the first spring mount 24 in mechanical communication, such as metal, metal composite, or synthetic polymer. The second gas spring mount pin is configured for securing the second gas spring to the second spring mount in mechanical communication. The second gas spring mount pin is substantially the same as the first gas spring mount pin 25.

The light mount shaft 28 is configured for receiving the light fixture 18. The light mount shaft 28 is in mechanical communication with the pivot arm 16. The light mount shaft 28 may be formed as a part of the pivot arm 16. The light mount shaft 18 may be configured for receiving the light fixture pin 17 to lock the light fixture 18 to the light mount shaft 18. When the light fixture 18 is locked to the light mount shaft 28, the light fixture pin 17 is in mechanical communication with the light mount shaft 28 and the light fixture 18.

The inline mast adapter 31 may include a handle 19. The handle 19 is configured for receiving a hand to rotationally lift and rotationally lower the pivot arm 16. The handle 19 and the pivot arm 16 may be formed as a single piece, such as through a cast mold, or the like. The handle 19 may be in mechanical communication with the pivot arm 16. The handle 19 may be formed to contour the hand. The handle 19 may include a foam portion configured for receiving the hand. The handle 19 may be made out of any material capable of receiving the hand, such as metal, metal composite, and synthetic polymer.

The inline mast adapter 31 may include a light fixture 18. The light fixture 18 is configured for providing indirect lighting to a work site. The light fixture 18 may be a light emitting diode (LED) light, a metal halide light, or a zero emission light. The light fixture may be a balloon light (e.g. lamp surrounded by fabric) or one or more spotlights.

The inline mast adapter 31, may include a light fixture pin 17. The light fixture pin 17 is configured for securing the light fixture 18 to the light mount shaft 28 in a non-permanent manner. The light fixture pin 17 may be a pin and clip mechanism or a pin mechanism. The light fixture pin 17 may be any material capable of securing the light fixture 18 to the light mount shaft 28 in a non-permanent manner, such as such as metal, metal composite, or synthetic polymer.

The vertical locking cradle 22 is in mechanical communication with the attachment system 202. The vertical locking cradle 22 may be in mechanical communication with the support arm 32 of the attachment system 202. The vertical locking cradle is configured to receive the pivot arm 16 when the inline mast adapter 31 is in the vertical position. The vertical locking cradle 22 is configured for locking the pivot arm 16 in the vertical position. The vertical locking cradle 22 is configured for receiving a vertical locking pin 12. The vertical locking cradle 22 may lock the pivot arm 16 in the vertical position via the vertical locking pin 12. In the locked, vertical position the vertical locking pin 12 is in sliding mechanical communication with the vertical locking cradle 22.

The vertical locking pin 12 is configured for securing the pivot arm 16 in the vertical locking cradle 22 in a non-permanent manner. The vertical locking pin 12 may be a pin and clip mechanism or a pin mechanism. The vertical locking pin 12 may be any material capable of securing the pivot arm 16 in the vertical locking cradle 22 in a non-permanent manner, such as such as metal, metal composite, or synthetic polymer.

The first gas spring 26 includes a first gas spring rod 27. The first gas spring 26 is in mechanical communication with the support bracket 8. The first gas spring 26 may be in mechanical communication with the support bracket 8, via the rod mount pin 9. The first gas spring 26 is in gaseous, dynamic communication with the first gas spring rod 27. In the vertical position, the first gas spring 26 is substantially vertical, and the first gas spring rod 27 is in an extended position. The first gas spring 26 may be a gas spring having a stroke from 16.51 to 21.59 centimeters (cm) (6.5 to 8.5 inches). Preferably, the stroke is approximately 19.05 cm (7.5 inches). The first gas spring 26 may have a progressivity from 10 percent to 30 percent (extended force/compressed force). Progressivity compares the force required to compress the fully expanded force (extended force) to the force exerted by the spring when compressed (compressed force). Progressivity from 10 percent to 30 percent exerts force on the pivot arm in a manner that allows rotational movement in a controlled manner. Preferably, the progressivity of the first gas spring 26 is 18 percent. For example, the first gas spring 26 may be a gas spring with an extended force of approximately 300 pounds of force (LBF), and a compressed force of approximately 354 LBF.

The second gas spring (not shown) includes a second gas spring rod (not shown). The second gas spring is in mechanical communication with the support bracket 8. The second gas spring may be in mechanical communication with the support bracket 8, via the rod mount pin 9. The second gas spring is in gaseous, dynamic communication with the second gas spring rod. In a vertical position, the second gas spring is substantially vertical, and the second gas spring rod is in an extended position. The second gas spring is substantially the same as the first gas spring 26.

The first gas spring mount 24 is configured for rotational movement. The first gas spring mount 24 is in mechanical communication with the first gas spring 26. The first gas spring mount 24 may be in mechanical communication with the first gas spring 26 via the first gas spring mount pin 25. The first gas spring mount 24 is in further mechanical communication with the pivot arm 16. The first gas spring mount 24 may be in mechanical communication with the pivot arm 16 via the two or more spring mount pins 23. In the vertical position the first gas spring mount 24 is substantially vertical.

The second gas spring mount is configured for rotational movement. The second gas spring mount is in mechanical communication with the second gas spring. The second gas spring mount may be in mechanical communication with the second gas spring via the second gas spring mount pin. The second gas spring mount is in further mechanical communication with the pivot arm 16. The second gas spring mount may be in mechanical communication with the pivot arm 16 via the two or more spring mount pins 23. In the vertical position the second gas spring mount is substantially vertical. The second gas spring mount is substantially the same as the first gas spring mount 24.

The pivot arm 16 is configured for rotational movement to align the light fixture 18 with the extendable tower mast 30 in the vertical position. The pivot arm 16 is in mechanical communication with the first gas spring mount 24, and the second gas spring mount. The pivot arm 16, the first gas spring mount 24, and the second gas spring mount may be formed as a single piece, such as through a cast mold, or the like. The pivot arm 16 may include a handle 19. The pivot arm 16 may be formed of any material capable of bearing the light fixture 18, such as metal, metal composite, or synthetic polymer. In the vertical position the pivot arm 16 is substantially vertical.

The release handle (not pictured) is configured to engage the first gas spring 26 and the second gas spring simultaneously or nearly simultaneously. Further, the release handle is configured to disengage the first gas spring 26 and the second gas spring simultaneously or nearly simultaneously. The release handle is in mechanical communication with the first gas spring 26 and the second gas spring. The release handle may be in mechanical communication with the first gas spring rod 27 of the first gas spring 26, and the second gas spring rod of the second gas spring. The release handle may be formed of any material capable of engaging the first gas spring 26 and the second gas spring, such as metal, metal composite, or synthetic polymer.

In a vertical position, the light fixture 18 is aligned with the extendable tower mast 30, such that the light mount shaft 28 may be 12.7 cm (5 inches) or less, as measured along the x-axis, from the attachment backing plate 5 of the attachment system 202. Preferably, the light mount shaft 28 is approximately 6.0325 cm (2.375 inches), as measured along the x-axis, from the attachment backing plate 5 of the attachment system 202. In the vertical position, the midpoint of the light fixture 18 may be 15.24 cm (6 inches) or less, as measured along the x-axis, from the extendable tower mast 30.

Figure 3:
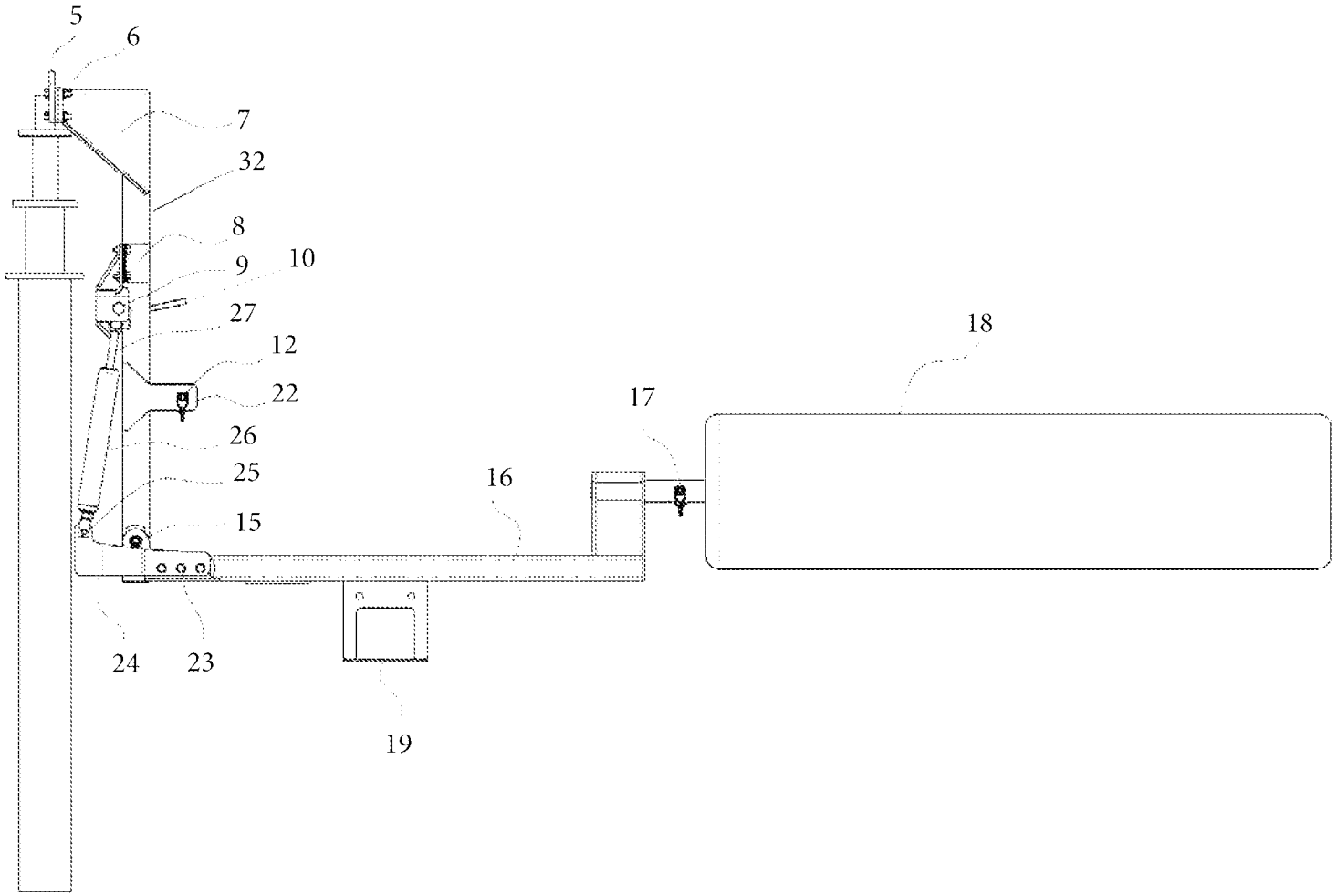
FIG. 3 is a first side view of an inline mast adapter in a horizontal position.

FIG. 3 is a first side view of an inline mast adapter in a horizontal position. In the horizontal position a first gas spring rod 27 of a first gas spring 26 is in a retracted position, and the first gas spring 26 is substantially vertical. In the horizontal position, the first gas spring mount 24 is substantially horizontal, and a pivot arm 16 is substantially horizontal.

Figure 4:
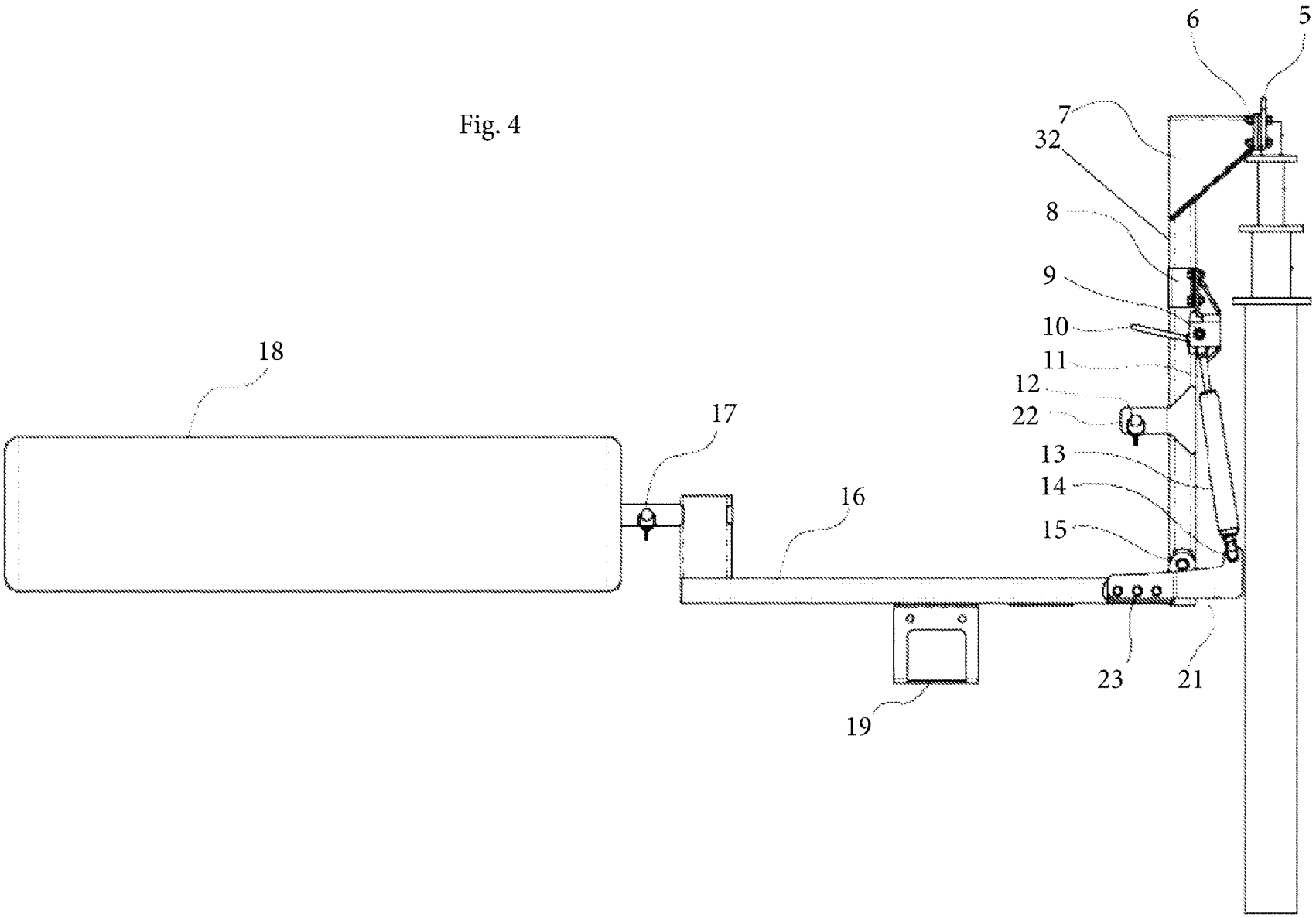
FIG. 4 is a second side view of an inline mast adapter in a horizontal position.

FIG. 4 is a second side view of an inline mast adapter in a horizontal position. In the horizontal position a second gas spring rod 11 of a second gas spring 13 is in a retracted position, and the second gas spring 13 is substantially vertical. In the horizontal position, the second gas spring mount 21 is substantially horizontal, and a pivot arm 16 is substantially horizontal.

Figure 5:
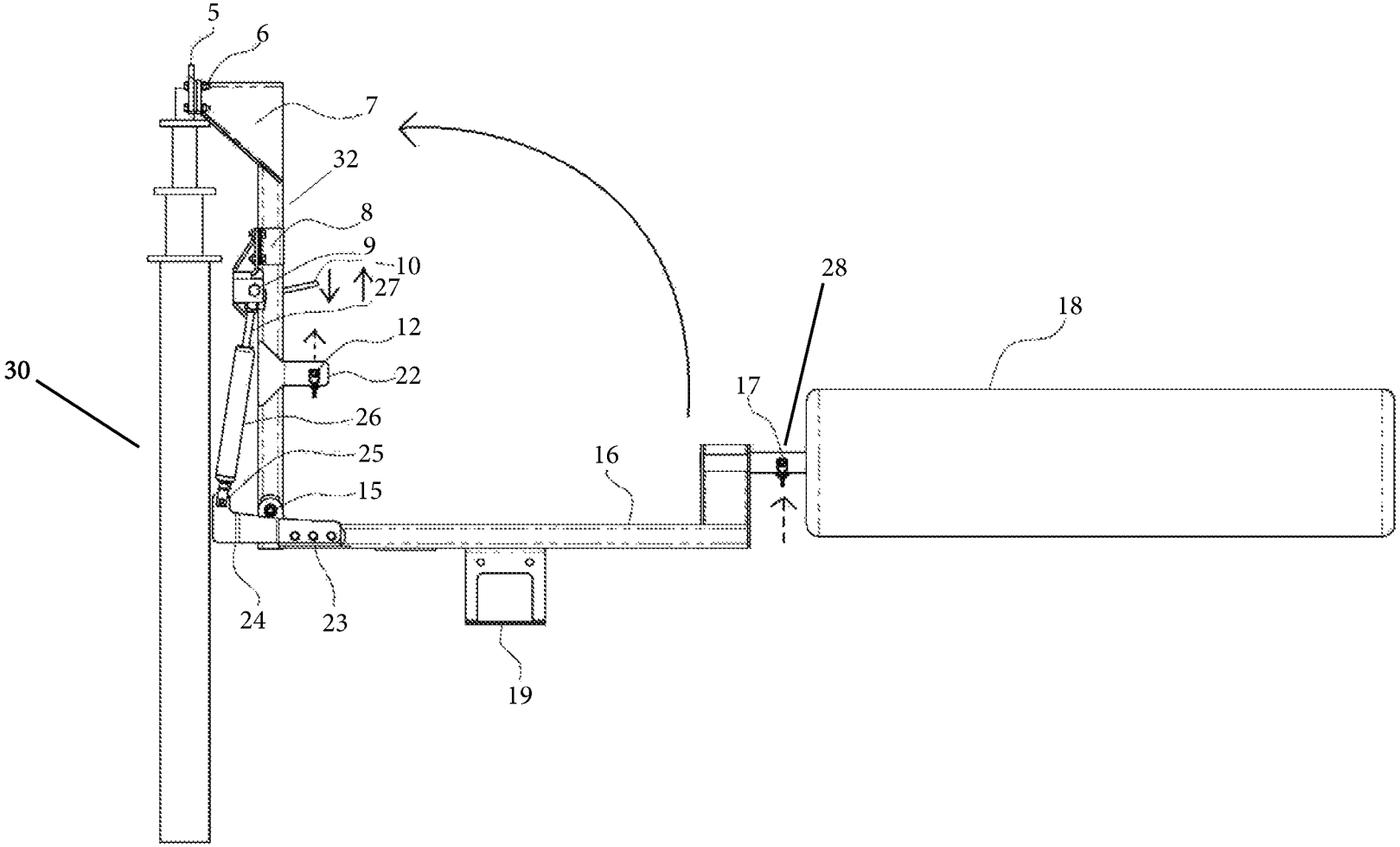
FIG. 5 illustrates a method of attaching a light fixture to an inline mast adapter to provide indirect lighting to a work site.

FIG. 5 illustrates a method for attaching a light fixture to an inline mast adapter at ground level to provide indirect lighting to a work site. A light fixture 18 is placed on a light mount shaft 28 from ground level. The light fixture 18 is secured on the light mount shaft 28. The light fixture 18 may be secured by sliding a light fixture pin 17 through the light fixture 18 and the light mount 28. The securing may further include clipping the light fixture pin 17 in place with a pin clip (not pictured).

A lift assist lever 10 is engaged to unlock a first gas spring rod 27 of a first gas spring 26 to allow the first gas spring rod 27 to move within the first gas spring 26, and to unlock, simultaneously or nearly simultaneously, a second gas spring rod (not pictured) of a second gas spring (not pictured) to move within the second gas spring. A pivot arm 16 is moved in a rotational manner to a vertical position, where the first gas spring 26 and the second gas spring do work on the pivot arm. The first gas spring 26 and the second gas spring may each supply a force of approximately 54 LBF on the pivot arm 16.

The pivot arm 16 is secured in the vertical position. The pivot arm 16 may be secured in the vertical locking cradle 22 by sliding the vertical locking pin 12 through the vertical locking cradle 22 when the pivot arm 16 is received by the vertical locking cradle 22. The securing may further include clipping the vertical locking pin 12 in place with a vertical pin clip (not pictured).

The lift assist release lever 10 is disengaged to lock the first gas spring rod 27 to prohibit the first gas spring rod 27 from moving within the first gas spring 26, and to lock, simultaneously or nearly simultaneously, the second gas spring rod to prohibit the second gas spring rod from moving within the second gas spring. The light fixture 18 is aligned with an extendable tower mast 30. The extendable tower mast 30 may be raised to its full height. Indirect light is provided to a work site.

Figure 6:
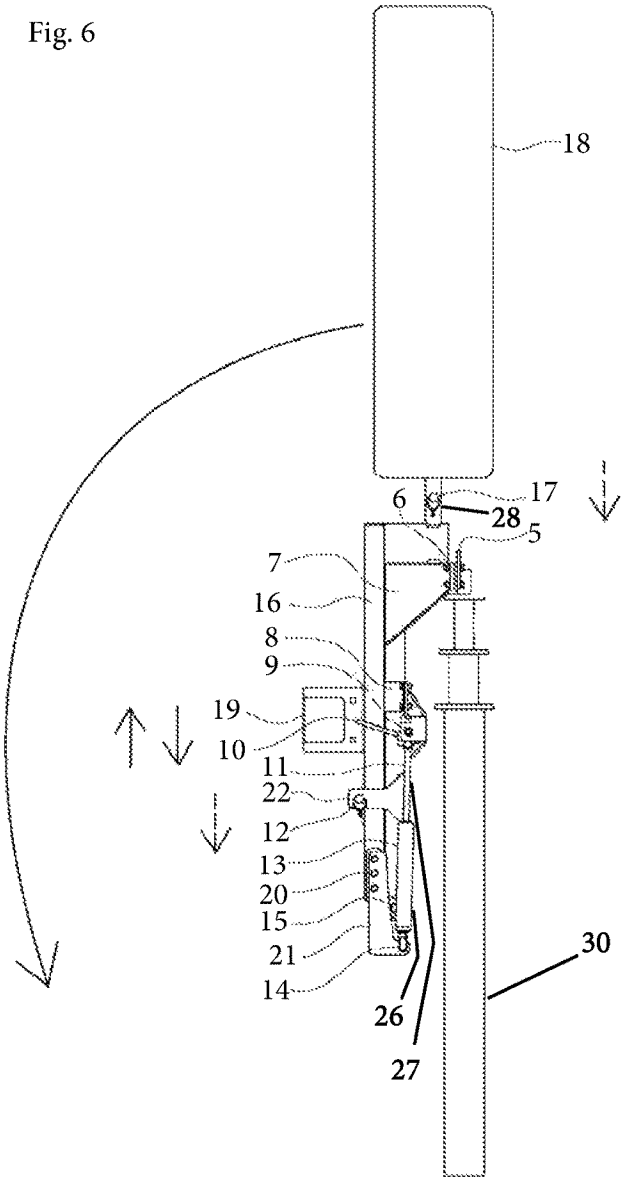
FIG. 6 illustrates a method of removing a light fixture from an inline mast adapter.

FIG. 6 illustrates a method for removing a light fixture from an extendable tower mast at ground level. The extendable tower mast 30 may be lowered to its lowest position. A pivot arm 16 is unsecured by removing a vertical cradle pin 12 from a vertical cradle lock 22. A lift release assist lever 10 is engaged to unlock a first gas spring rod 27 of a first gas spring 26 to allow the first gas spring rod 27 to move within the first gas spring 26, and to unlock, simultaneously or nearly simultaneously, a second gas spring rod (not pictured) of a second gas spring (not pictured), to allow the second gas spring rod to move within the second gas spring. A pivot arm 16 is moved downward in a rotational manner until the pivot arm 16 is in a horizontal position where the pivot arm 16 is substantially horizontal.

When the pivot arm 16 moves downward the first gas spring rod 27 moves into the first gas spring 26, and, simultaneously or nearly simultaneously the second gas spring rod moves into the second gas spring, increasing the pressure inside the first gas spring 26 and the second gas spring, such as by 54 LBF in each. The movement provides a charge to the first gas spring 26 and the second gas spring, when in the horizontal position.

The lift assist release lever 10 is disengaged to lock the first gas spring rod 27 of the first gas spring 26, such that the first gas spring rod 27 is prohibited from moving in the first gas spring 26, and to lock, simultaneously or nearly simultaneously, the second gas spring rod of the second gas spring, such that the second gas spring rod is prohibited from moving in the second gas spring. The light fixture 18 is removed from the light mount shaft 28. The removal of the light fixture 18 may include removing the light fixture pin 17 from the light mount shaft 28 and the light fixture 18.

Figure 7:
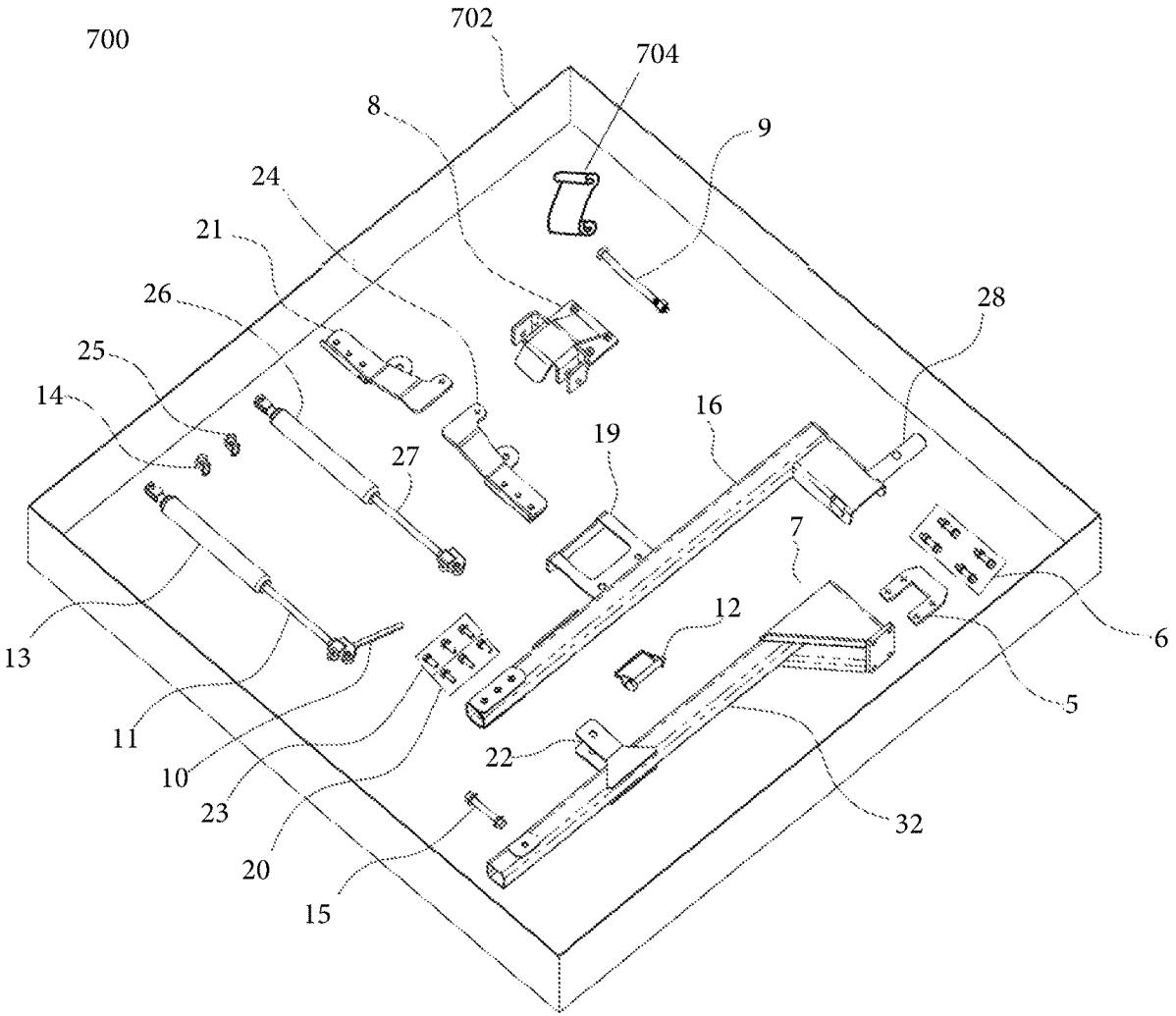
FIG. 7 illustrates an inline mast adapter kit.

FIG. 7 depicts an inline mast adapter kit 700. An inline mast adapter may be included in the inline mast adapter kit 700, which may be used to retrofit to an extendable tower mast to provide indirect lighting to a work site, where a light fixture may be aligned with the extendable tower mast, and the light fixture may be attached from the ground. The inline mast adapter kit 700 includes, an attachment backing plate 5, attachment hardware 6, an attachment frame 7, an attachment arm 32, a support bracket 8, a first spring mount 24, a second spring mount 21, at least two spring mount pins 23, a first gas spring 26, a second gas spring 13, a lift assist release lever 10, a first gas spring mount pin 25, a second gas spring mount pin 14, a rod mount pin 9, a pivot arm 16, a light mount shaft 28, a handle 19, a pivot arm pin 15, a vertical locking cradle 22, and a vertical pin 12. The inline mast kit may further include instruction 704 configured to provide direction on the assembly of the inline mast adapter and may further include instruction for addition to an extendable tower mast. The inline mast kit 700 may further include a container 702.

The attachment back plate 5, attachment hardware 6, and support bracket 8 may be grouped together, such as in a sealable plastic bag to prevent loss and structural damage of the parts. Further, the at least one spring mount pin 23, the first gas spring mount pin 25, the second gas spring mount pin 14, the rod mount pin 9, the pivot arm pin 15, and the vertical pin 12 may be grouped together, such as in a sealable plastic bag to prevent loss and structural damage of the parts.

Further, the pivot arm 16, the handle 19, and the light mount shaft 28 may be preassembled in mechanical communication in the kit 700 to reduce assembly steps for the inline mast adapter. The preassembled pivot arm 16, handle 19, and light mount shaft 28 may be at least partially surrounded by material to prevent structural damage, such as Styrofoam, bubble wrap, formed plastic, or packing peanuts.

The attachment frame 7, the attachment arm 32, and the vertical locking cradle 22 may be preassembled in mechanical communication in the kit 700 to reduce assembly steps for the inline mast adapter. The preassembled attachment frame 7, attachment arm 32, and vertical locking cradle 22 may be at least partially surrounded by material to prevent structural damage, such as Styrofoam, bubble wrap, formed plastic, or packing peanuts.

The first gas spring 26 and the lift assist release lever 10 may be preassembled in mechanical communication in the kit 700 to reduce assembly steps for the inline mast adapter. The preassembled first gas spring 26 and lift assist release lever 10 may be at least partially surrounded by material to prevent structural damage, such as Styrofoam, bubble wrap, formed plastic, or packing peanuts. The second gas spring 13 may be at least partially surrounded by material to prevent structural damage, such as Styrofoam, bubble wrap, formed plastic, or packing peanuts.

The container 702 is configured to contain the attachment backing plate 5, the attachment hardware 6, the attachment frame 7, the attachment arm 32, the support bracket 8, the first spring mount 24, the second spring mount 21, the least two spring mount pins 23, the first gas spring 26, the second gas spring 13, the lift assist release lever 10, the first gas spring mount pin 25, the second gas spring mount pin 14, the rod mount pin 9, the pivot arm 16, the light mount shaft 28, the handle 19, the pivot arm pin 15, the vertical locking cradle 22, and the vertical pin 12. The container may be of a material capable of holding the inline mast components, such as cardboard, plastic, or polystyrene. The container may include a lid. The container may be of any geometric shape configured for the holding the contents of the kit, such as a cuboid, cylinder, or rectangular prism.

The invention claimed is:

1. An inline mast adapter apparatus for adapting an extendable tower mast, the inline mast adapter comprising:

an attachment system, the attachment system comprising an attachment backing plate, attachment hardware, an attachment frame, and an attachment arm, wherein the attachment backing plate, the attachment hardware, the attachment frame, and the attachment arm are in mechanical communication;

a support bracket, wherein the support bracket is in mechanical communication with the attachment arm of the attachment system;

a first gas spring, the first gas spring comprising a first gas spring rod and a release handle, wherein the first gas spring rod is in gaseous communication with the first gas spring, and wherein the release handle is in mechanical communication with the first gas spring rod, and wherein the first gas spring is in mechanical communication with the support bracket;

a second gas spring, the second gas spring comprising a second gas spring rod, wherein the second gas spring rod is in gaseous communication with the second gas spring, and wherein the second gas spring rod is in mechanical communication with the release handle, and wherein the second gas spring is in mechanical communication with the support bracket;

a first gas spring mount, wherein the first gas spring mount is in mechanical communication with the first gas spring;

a second gas spring mount, wherein the second gas spring mount is in mechanical communication with the second gas spring; and a pivot arm, the pivot arm comprising a light mount shaft, wherein the light mount shaft is in mechanical communication with the pivot arm, and wherein the pivot arm is in mechanical communication with the first gas spring mount, the second gas spring mount, and the attachment arm of the support system.

2. The apparatus of claim 1, wherein the pivot arm further comprises a handle configured to receiving a hand, wherein the handle is in mechanical communication with the pivot arm.

3. The apparatus of claim 2, further comprising:

a rod mount pin configured to mechanically communicate with the support bracket, the first gas spring, and the second gas spring;

at least two spring mount pins configured to mechanically communicate with the first gas spring, the second gas spring, and the pivot arm; and a vertical locking cradle configured to receive the pivot arm in a vertical position.

4. The apparatus of claim 3, wherein the vertical locking cradle comprises a vertical locking pin configured to lock the pivot arm in the vertical position.

5. The apparatus of claim 1, further comprising a light fixture, wherein the light fixture is in mechanical communication with the light mount shaft.

6. The apparatus of claim 5, wherein the light fixture is a balloon light.

7. The apparatus of claim 1, wherein the first gas spring has a progressivity from 16 percent to 20 percent (extended force/compressed force), and wherein the second gas spring has a progressivity from 16 percent to 20 percent (extended force/compressed force).

8. The apparatus of claim 1, wherein the light mount shaft is from 0.0254 centimeters to 12.7 centimeters from the attachment backing plate in a vertical position.

9. The apparatus of claim 7, wherein the light mount shaft is 6.0325 centimeters from the attachment backing plate in the vertical position.

10. The apparatus of claim 1, wherein the attachment frame and the attachment arm are a single piece.

11. The apparatus of claim 2, wherein the pivot arm and the handle are a single piece.

12. A method for attaching a light fixture to an inline mast adapter at ground level to provide indirect light to a work site, the method comprising:

placing a light fixture on a light mount shaft of a pivot arm of an inline mast adapter;

engaging a lift assist lever of a first gas spring to allow the first gas spring and a second gas spring to move, wherein the lift assist lever is in mechanical communication with the first gas spring and the second gas spring;

lifting the pivot arm in a substantially rotational movement to a vertical position, wherein the light mount shaft is from 0.0254 centimeters to 12.7 centimeters from an attachment backing plate in the vertical position;

locking the pivot arm in the vertical position;

disengaging the lift assist lever of the first gas spring to lock the first gas spring and the second gas spring;

providing indirect light to the work site.

13. The method of claim 12, further comprising:

securing the light fixture on the light mount shaft, wherein a light fixture pin is in mechanical communication with the light mount shaft and the light fixture.

14. The method of claim 13, wherein the light mount shaft is 6.0325 centimeters from the attachment back plate in the vertical position.

15. The method of claim 12, wherein the first gas spring has a progressivity from 16 percent to 20 percent (extended force/compressed force), and wherein the second gas spring has a progressivity from 16 percent to 20 percent (extended force/compressed force).

16. An inline mast adapter kit comprising:

an inline mast adapter comprising, an attachment backing plate, attachment hardware, an attachment frame, an attachment arm, a support bracket, a first spring mount, a second spring mount,
at least two spring mount pins,
a first gas spring,
a second gas spring,
a lift assist release lever,
a first gas spring mount pin,
a second gas spring mount pin,
a rod mount pin,
a pivot arm,
a light mount shaft,
a handle,
a pivot arm pin,
a vertical locking cradle,
and a vertical pin.

17. The kit of claim 16, wherein the attachment backing plate, the attachment hardware, and the support bracket are in a first sealable plastic bag, and the at least two spring mount pins, the first gas spring mount pin, the second gas spring mount pin, the rod mount pin, the pivot arm pin, and the vertical pin are in a second sealable plastic bag.

18. The kit of claim 16, wherein the pivot arm, the handle, and the light mount shaft are assembled in mechanical communication, and wherein the attachment frame, the attachment arm, and the vertical locking cradle are assembled in mechanical communication.

19. The kit of claim 16, further comprising an instruction configured to instruct assembly of the inline mast adapter.

* * * * *